United States Patent [19]

Snyder et al.

[11] 4,343,398

[45] Aug. 10, 1982

[54] EMULSION PACKAGE AND METHOD OF MIXING THE EMULSION

[75] Inventors: Robert G. Snyder, Norway, Me.; John J. Clancy, Westwood; Richard S. Brenneman, Natick, both of Mass.

[73] Assignee: Engineering Industries, Inc., Norway, Me.

[21] Appl. No.: 179,730

[22] Filed: Aug. 20, 1980

[51] Int. Cl.[3] ..... B65D 81/30; B65D 35/28; B65D 33/36; B65D 85/00

[52] U.S. Cl. ..... 206/219; 206/447; 206/524.8; 206/525

[58] Field of Search ..... 206/219, 447, 524.3, 206/524.8, 525

[56] References Cited

U.S. PATENT DOCUMENTS

| | | | |
|---|---|---|---|
| 2,052,158 | 8/1936 | Zink . | |
| 2,347,640 | 5/1944 | Peters . | |
| 2,454,420 | 11/1948 | Adlet et al. . | |
| 2,469,204 | 5/1949 | Peters . | |
| 2,469,521 | 5/1949 | Rohdin . | |
| 2,502,920 | 4/1950 | Brown . | |
| 2,529,837 | 11/1950 | Denison . | |
| 2,532,513 | 12/1950 | Peters . | |
| 2,539,457 | 1/1951 | Metheny et al. | |
| 2,553,413 | 5/1951 | Denison et al. | |
| 2,566,122 | 8/1951 | Denison . | |
| 2,576,834 | 11/1951 | Hensgen . | |
| 2,598,595 | 5/1952 | Peters . | |
| 2,600,216 | 6/1952 | Denison . | |
| 2,605,896 | 8/1952 | Rohdin . | |
| 2,606,121 | 8/1952 | Peters . | |
| 2,607,697 | 5/1943 | Brown . | |
| 2,617,733 | 11/1952 | Hensgen . | |
| 2,672,268 | 3/1954 | Bower | 206/524.8 |
| 2,745,754 | 5/1956 | Steinbock . | |
| 2,828,858 | 4/1958 | Tooke . | |
| 2,863,305 | 12/1958 | Shepherd | 206/219 |
| 3,061,165 | 10/1962 | Rench et al. | |
| 3,064,802 | 11/1962 | Jess et al. | 206/219 |
| 3,101,839 | 8/1963 | Holman . | |
| 3,119,258 | 12/1968 | Ritchie | 206/219 |
| 3,321,070 | 5/1967 | Childs | 206/524.3 |
| 3,430,815 | 3/1969 | Weimer et al. | 206/219 |
| 4,205,611 | 6/1980 | Slawinski . | |
| 4,213,530 | 7/1980 | Harris et al. | 206/447 |

OTHER PUBLICATIONS

"Thermoplastic Container for Margerine", *Modern Plastics*, vol. 23, pp. 106–107, 1946.

"Packaging Award to the Cudahy Packing Company", *Modern Plastics*, vol. 26, pp. 154–155, Sep. 1948.

Liqui-Box Corporation brochure number C1EG-3M.

"Pouch with a Purpose", *Packaging Digest*, Feb. 1981, pp. 41 & 44.

*Primary Examiner*—William T. Dixson, Jr.

*Attorney, Agent, or Firm*—Hamilton, Brook, Smith and Reynolds

[57] ABSTRACT

A coal tar emulsion driveway sealer is packaged in a sealed bag. The volume of sealer is less than half the capacity of the bag and the bag is substantially completely evacuated but for the sealer. The separated sealer is mixed by compressing the sides of the bag to induce turbulent flow of the paste and liquid for hydraulic mixing thereof. The sealer may be dispensed at a controlled rate without spattering by cutting a corner from the bag to provide a pour spout. The bag with the sealer may be contained in a carton.

19 Claims, 6 Drawing Figures

EMULSION PACKAGE AND METHOD OF MIXING THE EMULSION

DESCRIPTION

1. Technical Field

This invention relates to the packaging, mixing and dispensing of emulsions. It has particular application to the packaging of coal tar emulsion driveway sealer.

2. Background

The most widely used driveway sealer is a thick, black, coal tar emulsion. It is generally sold retail in large 50 pound metal or plastic pails with lids. In storage, the emulsion separates into a heavy paste topped by a layer of watery liquid. The degree of separation depends on the storage time and conditions, but the layer of supernatant liquid typically makes up 5% to 30% of the material by volume. Viscosities of the sealer and its separated components have been measured at 75° F. with a Brookfield Syncho-Lectric viscometer Model RVT at 5 RPM using the Helipath stand for vertical travel. After about three weeks of settling, the settled paste has a viscosity of about 350,000 centipoises and after about six months the paste has a viscosity of about 600,000 centipoises. When mixed with the liquid, which has a viscosity of less than one centipoise, an emulsion having a viscosity of about 13,000 centipoises is obtained.

Mixing and dispensing the driveway sealer from a pail can be a very disagreeable task. The lid is often difficult to remove. Once the lid is removed, mixing of the heavy, settled paste with the thin, watery liquid is time consuming and inevitably results in messy spattering of the sealer onto the surrounding ground and onto the individual mixing the sealer. Once the sealer is thoroughly mixed, usually after about ten minutes of effort, it must be poured from the pail onto the driveway, and it must be smoothed out with a squeegee or brush. When poured, the sealer again spatters on the user as well as on any adjacent wall or the like. The spattered sealer is difficult to clean from the user's clothing or adjacent surface and is an irritant to the user's skin.

The primary object of this invention is to provide a means for mixing and dispensing a heavy emulsion such as driveway sealer with much less time, effort and mess than has heretofore been possible and without the need for a mixing implement.

Conventional pails for storing driveway sealer provide reasonable stacking strength and resist blows from the side. However, the rims of pails are easily crushed when dropped at an angle. This is a particular problem when attempting to carry heavy fluids such as 50 pounds of driveway sealer. When a rim of the bucket is crushed, the pail not only loses its stacking ability; it is also subject to leakage of the sealer. Other disadvantages of conventional pails include the cost of metal or plastic and the cost of forming the pails. Also, the stacking of cylindrical pails results in a substantial loss of storage space due to the voids between the stacked pails. The weight of the pails also contributes significantly to the cost of transporting the sealer. Finally, filling of the pails with the heavy emulsion is a time consuming process which does not readily lend itself to mechanization.

A further object of the present invention is to provide a package for storing emulsion such as driveway sealer which is relatively economical and durable and which lends itself to high density storage on pallets and the like and high speed filling.

DISCLOSURE OF THE INVENTION

An emulsion such as coal tar driveway sealer is packaged in a sealed bag. The volume of the emulsion in the bag is less than half the capacity of the bag. The bag is evacuated of substantially all air. The separated emulsion can be mixed by laying the bag flat on the ground and pressing the top face of the bag to induce the turbulent flow of the emulsion components for hydraulic mixing of those components.

The flexible bag provides for ease of dispensing of the sealer onto a driveway with controlled flow through a spout which may be a severed corner of the bag.

Preferably, the bag is of thermoplastic material and it lies in a flat rectangular sheet when empty. The partially filled and sealed bag may be packaged in a carton. For reasons of cost and ease of handling, driveway sealer should be packaged in quantities within the range of 1 to 3½ gallons.

To enhance the hydraulic mixing of the emulsion, flow restrictions may be formed in the bag by heat sealing or the like.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

PREFERRED EMBODIMENT OF THE INVENTION

A coal tar emulsion driveway sealer is packaged in a thermoplastic bag 12. The bag 12 is of a material which is substantially impermeable to the components of the driveway sealer over a typical shelf life of the package. Based on considerations of impermeability, a two layer bag membrane of 3 mil, ethylene/vinyl acetate copolymer (EVA) has been chosen. To make the bag even less permeable to sealer vapors, an aluminum foil layer may be provided. The increased barrier properties of such a bag is generally offset by the increased cost of the bag, however.

The bag 12 is formed of four flat membranes joined along a rectangular periphery 14 so that, when empty, it can be laid flat on one face with complete face-to-face contact. Driveway sealer is introduced into the flat, empty bag through an inlet port 16 during a filling operation. The bag is filled to less than half its total capacity. As little air as possible is introduced into the bag during filling or it is later vacuum evacuated so that it is substantially completely evacuated but for the sealer.

Figure 1:
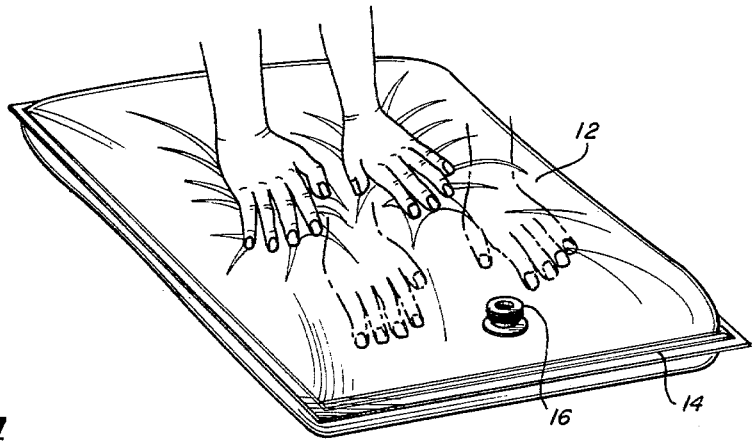
FIG. 1 is a perspective view of a thermoplastic bag partially filled with driveway sealer in accordance with this invention, showing hydraulic mixing of the sealer by compression of the bag with two hands.

The incomplete filling of the bag 12 with driveway sealer is important to enable mixing of the separated components of the sealer without opening the bag. Preferably, just prior to opening the bag 12 to dispense the sealer, the bag is laid on a flat surface as shown in FIG. 1 and the bag is compressed with two hands so that the upper bag face contacts the lower face. Pressure to the bag may then be quickly and repeatedly released and reapplied in a pumping action. Preferably, the hands are moved to different portions as shown in phantom with each pumping action. The hands may also be pressed against the bag alternately rather than together. Further, a foot may be used for the pumping movement. This pumping action causes a turbulent flow of the paste and liquid in the bag and results in complete hydraulic mixing of the contents of the bag within about one minute. As an alternative to the rapid pumping action, the upper face may be pressed down against the lower face to cause flow of the sealer, and then the hands or foot may be moved laterally with the two bag faces still pressed together to cause a shearing action on the paste between the two bag faces. Repetitive pressing of the bag faces and lateral movement causes turbulent flow of the bag contents for hydraulic mixing of the separated contents and also allows the individual to smooth out any globules of paste in the mixture.

Hydraulic mixing of the sealer in bags as shown in FIG. 1 allows for mixing of the sealer in less than one-third the time required to mix the same amount of sealer in five gallon pails. Tests have shown that it takes from seven to ten minutes to adequately mix the contents of a five gallon pail. Only about one minute is required to adequately mix $2\frac{1}{2}$ gallons of sealer which has settled for several months in a bag by hydraulic mixing. Where the sealer has settled for less than a month, mixing can be completed in only about thirty seconds or less.

Figure 2:
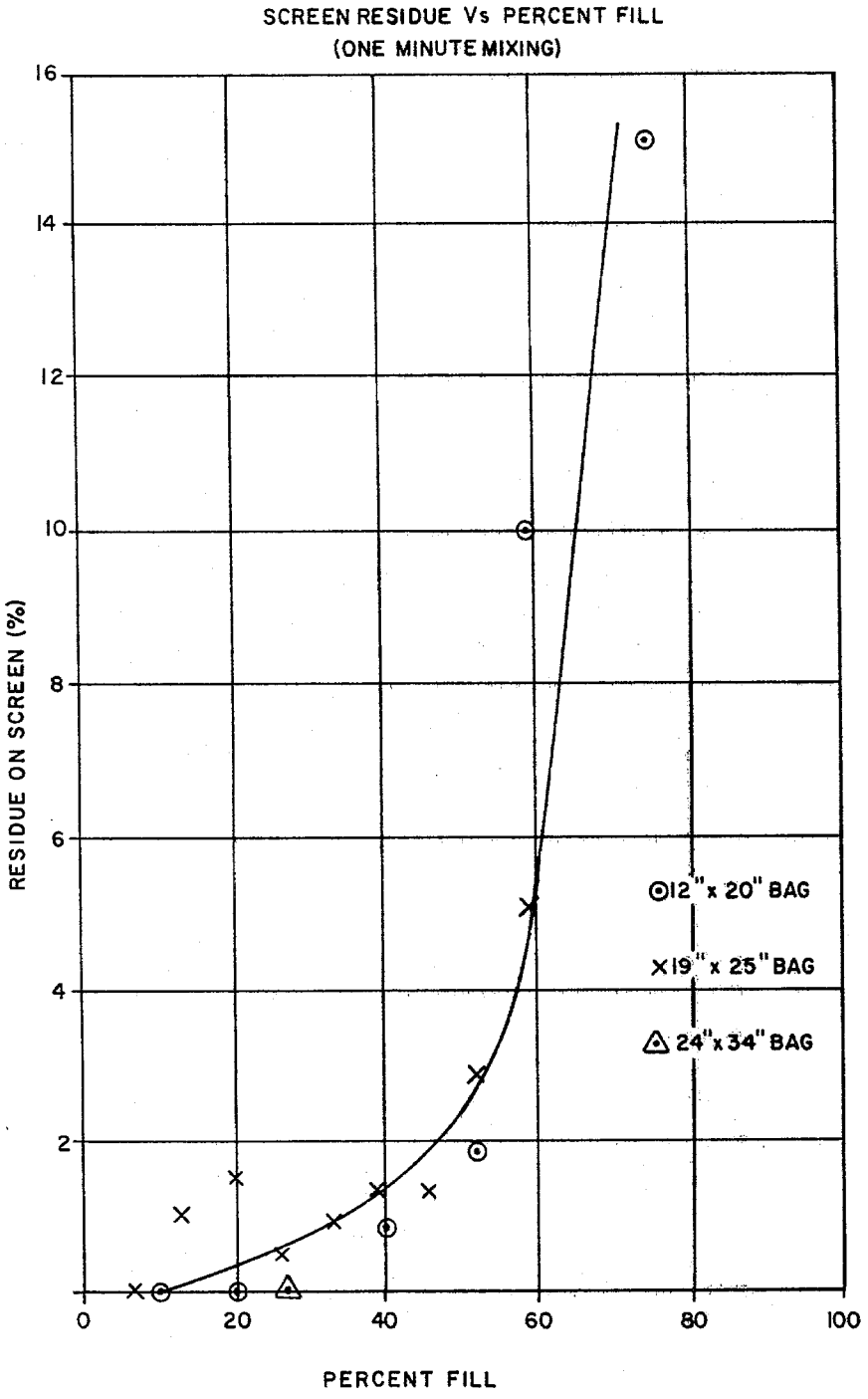
FIG. 2 graphically illustrates experimental results which demonstrate the need for having a fill ratio of less than about ½ for quick mixing.

It is important that the bag be only partially filled with sealer and that it be substantially completely evacuated but for the sealer. This partial filling allows for the pumping or smoothing action and the turbulent flow which results in the hydraulic mixing of the sealer. FIG. 2 shows the results of tests in which three differently sized bags were filled to different degrees. The medium size bag was a $19\times25$ inch rectangle when empty and laid flat. It had a maximum capacity of 7.9 gallons. Such a bag is conventionally used to contain about five gallons of liquid. The smaller bag was a $12\times20$ inch rectangle when empty and laid flat and had a total capacity of 3.1 gallons. It is conventionally used to hold two gallons of liquid. A single test was made of a much larger bag, $24\times34$ inches, which had a total capacity of 18 gallons and is ordinarily used to carry over ten gallons of liquid.

The degree of mixing, as indicated by the percent of undispersed paste collected on a sieve, was determined after sixty seconds of mixing. The degree of mixing was indicated by the amount of paste retained on a one-half inch mesh screen of a six inch square sieve when the contents of the bag or pail were poured over the screen. The sealer was considered to be adequately mixed when the weight of the sealer collected on the sieve was less than two percent of the total weight of the sealer.

The results of the tests shown in FIG. 2 indicate that it is critical that the bag be filled to less than about 50% of its total capacity to provide for quick mixing; that is, it must have a fill ratio of less than $\frac{1}{2}$. Preferably, the percent fill is less than 45%.

Although the large 18 gallon capacity bag allowed for excellent mixing of 5 gallons, or about 50 pounds of sealer, this bag was considered to be to unwieldy for most applications. Three and one-half gallons is considered to be the upper limit of an easily handled bag of driveway sealer. On the other hand, to maintain a reasonable cost of the bag relative to its contents and to provide a reasonable volume of sealer for use in most applications the bag should hold at least one gallon of sealer.

It is significant that, for the 7.9 gallon capacity bag, it was also found that film to film contact between the two faces of the bag, as shown in FIG. 1, could not be readily made with two hands without excessive pressure when the volume of liquid in the bag was 3.6 gallons or greater. This is a percent fill of 45%. It is where face to face contact can be made with two hands that the contents of the bag can be most readily and quickly mixed by the turbulent flow of the hydraulic mixing process. Face to face contact could not even be made with one hand when the percent fill was greater than about 50%, and without such contact the ability to easily mix the separated contents of the bag is lost.

Figure 4:
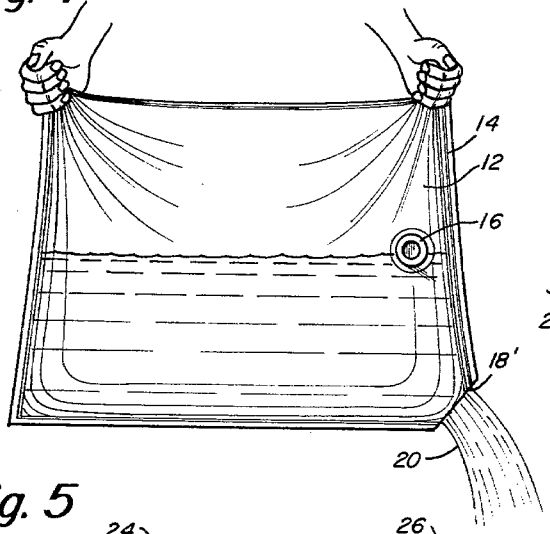
FIG. 4 is a view of the partially filled bag of FIG. 1 with a larger cut from the corner of the bag for dispensing of the driveway sealer as a wide but controlled stream.
Figure 6:
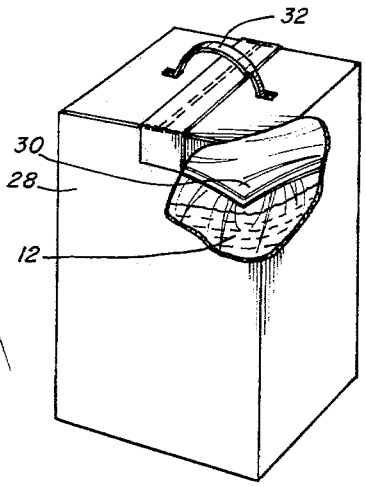
FIG. 6 is a perspective view, partially broken away, of the bag of FIG. 1 stored in a carton.
Figure 3:
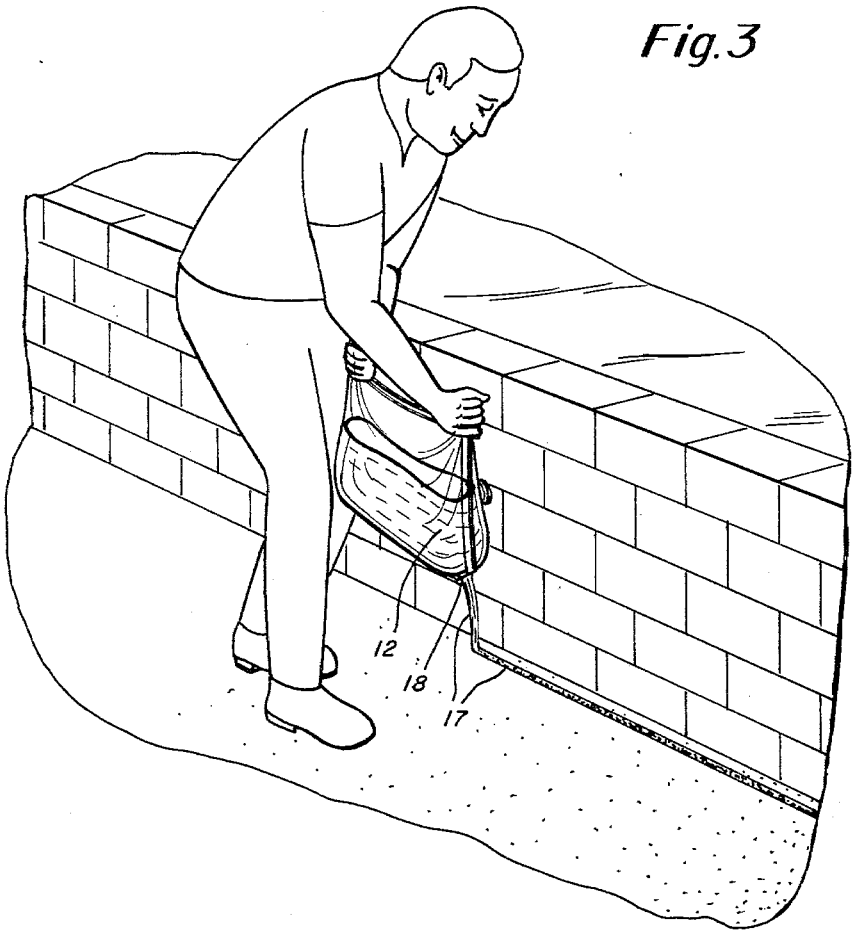
FIG. 3 is a view of the bag of FIG. 1 with a corner cut from the bag for controlled dispensing of a bead of driveway sealer adjacent a wall.

The package disclosed above for coal tar emulsion driveway sealer has the further advantages of easy opening and clean and easy dispensing as illustrated in FIGS. 3 and 4. A corner of the plastic bag 12 may be quickly cut from the bag as at 18. Because the bag is less than half filled, two corners of an opposite edge of the bag can be readily grasped as shown, and the bag can be lifted and tilted to pour the sealer 20. As shown in FIG. 3, by cutting only a small tip 18 of the corner from the bag, a very small pour spout can be provided for very controlled dispensing of a bead 17 of sealer near walls and the like. Controlled pouring of the sealer adjacent to walls and the like is not possible with a large pail.

For more rapid pouring of the sealer from the bag, a larger amount of the corner plastic can be cut from the bag as at 18' of FIG. 4 to provide a wide pour spout. The size of that spout depends on the ambition of the user. Although this larger spout allows for rapid pouring of the sealer onto a driveway, it results in essentially no spattering which compares with a great deal of spattering with the conventional pail. This is because a relatively small opening is provided in the bag. Also, the very flexible, half-filled bag can be positioned so that the spout is close to the ground before the bag is tipped for pouring through the spout. With a pail, pouring of the sealer is initiated from a height of twelve inches or greater.

Once a desired quantity of sealer is poured from the bag, the bag can be set on a flat surface. The sealer is sufficiently thick that the bag can be positioned to prevent loss of sealer through the open corner until additional sealer is required. If the bag contents are only partially used, or in the unlikely event that the contents are inadequately mixed, the bag can be resealed by a conventional tie. A conventional pail cannot be as readily resealed.

Figure 5:
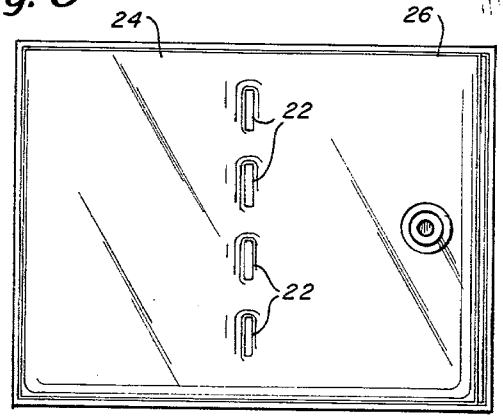
FIG. 5 is a plan view of an alternative embodiment of a driveway sealer packing in which flow restrictions are provided in the bag by heat sealing of the bag faces.

An alternative bag design is shown in FIG. 5. In this design orifices are provided between two ends 24 and 26 of the bag by means of heat seals 22. With this bag design, the sealer can be pumped from one half of the bag to the other through the orifices. The orifices cause added turbulent flow to improve the hydraulic mixing of the sealer.

The thermoplastic bag is sufficiently durable that it may be handled without the need for further packaging. Such a use of the bag as the sole container provides for maximum density stacking of the container. It also minimizes the cost of the package. When individually sold, the bag may be carried by the purchaser by a handle integral with the bag or in a paper or plastic shopping bag which preferably has an integral handle.

The plastic bag may be contained in a carton 28 as shown in FIG. 7. With the very low fill ratio, the flexible bag 12 and its contents conform to the shape of the carton. Excess bag membrane 30 can be folded at the top of the carton. Alternatively, the bag can be partially folded into the carton prior to filling, and then the bag can be filled while positioned in the carton. The carton shown in FIG. 7 also includes a plastic carrying handle 32.

The primary advantages to the consumer of the above-disclosed driveway sealer package are the ease of mixing, the ease of opening the container, the ease and cleanliness of dispensing the sealer, and the better disposability of the bag and carton as compared to a pail. There are also significant advantages to those who sell the sealer. The cost of the plastic bag with a carton is 15% to 20% less than that of a metal or plastic pail. Without the carton the savings is substantially greater. There is also a savings in the cost of transporting packaged sealer because of the lighter weight of the plastic bag and carton relative to a metal pail. Further, both the bag alone and the bag in a carton allow for much greater stacking density of both empty and filled containers than does a round pail.

Further cost savings in fabricating bags for containing the sealer can be had by eliminating the need for a discrete fill spout. For example, one end of the bag may be only partially sealed prior to filling to provide an opening in the bag. The opening can then be sealed after filling by a heat seal, metal tie or the like. Such bags may be formed by heat sealing a plastic tube to provide a continuous roll of empty bags. The intersection between such bags in a roll may be shaped to provide for an extended spout from the top of each bag.

A further advantage of the plastic bag package is that it is more resistant to damage when dropped. A pail cannot generally withstand a drop on edge from more than 14 inches. The bag, in or out of a carton, can be dropped from several feet without damage. The result is significantly less leakage from a supply of containers.

The filling of pails is a time consuming process. It generally requires three men to fill the pails at a rate of three pails per minute. By providing an individual with a large supply of plastic bags, he can be expected to fill over ten bags, with 2½ gallons each, per minute. Thus, one individual can fill bags with driveway sealer at a much faster rate than that at which three individuals can fill pails. He can inject the driveway sealer through the small opening 16 of an evacuated bag very quickly without the spattering that occurs with an open top pail.

While the invention has been particularly shown and described with references to preferred embodiments thereof, it will be understood by those skilled in the art that various changes in form and details may be made therein without departing from the spirit and scope of the invention as defined by the appended claims.

We claim:

1. A package comprising a fluid product in a sealed bag, the fluid product having a normal viscosity of about 13,000 centipoises or less but being subject to separation into a paste and liquid, the liquid having a watery consistency and making up at least about 5% of the separated bag contents, the volume of product being at least one gallon and less than half the capacity of the bag, and the bag being substantially completely evacuated but for the product such that the separated contents of the bag may be remixed by compressing the sides of the sealed bag into face-to-face contact by hand, inducing turbulent flow of the bag contents for hydraulic mixing thereof.

2. A coal tar emulsion driveway sealer package comprising at least about one gallon of coal tar emulsion driveway sealer product, which is subject to separation, in a sealed bag, the volume of sealer being less than half the capacity of the bag and the bag being substantially completely evacuated but for the sealer such that the separated components of the driveway sealer may be remixed by compressing the sides of the sealed bag into face-to-face contact to induce turbulent flow of the sealer for hydraulic mixing thereof.

3. A package as claimed in claim 1 or 2 wherein between 1 and 3½ gallons of product are contained in the bag.

4. A package as claimed in claim 1 or 2 wherein the bag, when empty, may be laid flat with complete face to face contact of opposed faces of the bag.

5. A package as claimed in claim 1 or 2 further comprising orifices formed between two sections of the interior of the bag by means of sealing of opposed faces of the bag, each section making up about half of the total volume of the bag, the orifices providing for increased turbulence in hydraulic mixing.

6. A package as claimed in claim 1 or 2 further comprising a carton, the sealed bag being positioned in the carton.

7. A method of storing and mixing a fluid product which is subject to separation, the method comprising sealing a stored volume of the product in a bag, the bag having a total capacity of at least twice the stored volume and being substantially completely evacuated but for the stored product, and mixing the stored volume of product within the sealed bag by laying the bag in a generally flat orientation on a substantially flat surface and compressing the sides of the bag into face-to-face contact at a sufficient velocity to induce turbulent flow of the product for hydraulic mixing thereof.

8. A method of storing and mixing a coal tar emulsion sealer product which is subject to separation to a paste and liquid, the method comprising sealing a stored volume of the emulsion in a bag, the bag having a total capacity of at least twice the stored volume and being substantially completely evacuated but for the stored emulsion, and mixing the stored volume of emulsion within the sealed bag by compressing the sides of the bag to induce turbulent flow of the paste and liquid for hydraulic mixing thereof.

9. A method of storing, mixing and dispensing a coal tar emulsion driveway sealer which is subject to separation to a paste and liquid, the method comprising sealing a stored volume of the sealer in a bag, the bag having a total capacity substantially greater than the stored volume and being substantially completely evacuated but for the stored emulsion, mixing the stored volume of emulsion within the sealed bag by compressing the sides of the bag to induce turbulent flow of the paste and liquid for hydraulic mixing thereof, and dispensing the sealer from the bag by tilting the bag for flow of the mixed sealer through a pour spout at a rate controlled by the area of the spout.

10. A method of storing and mixing a fluid product which is subject to separation, the method comprising sealing a stored volume of the product in a bag, the bag having a total capacity substantially greater than the stored volume of product, and mixing the stored volume of product within the sealed bag by compressing the sides of the bag into face-to-face contact at a sufficient velocity to induce turbulent flow of the product for hydraulic mixing thereof.

11. A method as claimed in claim 7, 8, 9 or 10 wherein between 1and 3½ gallons of product are stored and mixed in the bag.

12. A method as claimed in claim 7, 8, 9 or 10 wherein the product is mixed by repeatedly compressing one face of the bag against another in a pumping action to create turbulent flow of the product in the bag.

13. A method as claimed in claim 12 wherein the bag is repeatedly compressed by forcing hands or feet against a face of the bag.

14. A method as claimed in claim 7, 8, 9 or 10 wherein the bag, when empty, may be laid flat with complete face to face contact of opposing faces of the bag.

15. A method as claimed in claim 7, 8, 9 or 10 wherein the bag includes orifices between two sections of the interior thereof, each section making up about half of the total volume of the bag, the orifices providing for increased turbulence in hydraulic mixing.

16. A method as claimed in claim 9 wherein the pour spout is provided by cutting a corner from the bag.

17. A method of packaging a coal tar emulsion driveway sealer product comprising sealing a stored volume of the sealer in an otherwise substantially evacuated bag, the stored volume being less than 50% of the total capacity of the bag.

18. A method as claimed in claim 17 wherein the stored volume is less than 45% of the total capacity of the bag.

19. A method as claimed in claim 17 wherein the stored volume is between one and 3.5 gallons.

* * * * *